US005211291A

United States Patent [19]

Kelley et al.

[11] Patent Number: 5,211,291

[45] Date of Patent: May 18, 1993

[54] VIBRATORY SEPARATOR PLATE FOR FLAKE-LIKE MEMBERS

[75] Inventors: Christopher P. Kelley, Boston; John A. Tanner, Amherst, both of N.Y.

[73] Assignee: Derrick Manufacturing Corporation, Buffalo, N.Y.

[21] Appl. No.: 788,867

[22] Filed: Nov. 7, 1991

[51] Int. Cl.[5] ..... B07B 1/46; B07B 13/14

[52] U.S. Cl. ..... 209/680; 209/264; 209/397

[58] Field of Search ..... 209/680, 397, 263, 264, 209/265, 540, 541, 544, 682

[56] References Cited

U.S. PATENT DOCUMENTS

| | | | |
|---|---|---|---|
| 348,128 | 8/1886 | Keeney | 209/682 |
| 865,185 | 9/1907 | Kerrigan | 209/397 |
| 1,667,194 | 4/1928 | Craig et al. | 209/397 |
| 1,731,115 | 10/1929 | Taylor | 209/397 |
| 2,391,501 | 12/1945 | O'Brien | 209/397 |
| 4,882,044 | 11/1989 | Freissle | 209/405 X |

FOREIGN PATENT DOCUMENTS

| | | | |
|---|---|---|---|
| 517962 | 10/1952 | Canada | 209/397 |
| 2108854 | 8/1972 | Fed. Rep. of Germany | 209/397 |
| 209397 | 5/1984 | Fed. Rep. of Germany | 209/397 |
| 80181 | 1/1956 | Netherlands | 209/682 |
| 822926 | 4/1981 | U.S.S.R. | 209/397 |

*Primary Examiner*—Donald T. Hajec
*Attorney, Agent, or Firm*—Joseph P. Gastel

[57] ABSTRACT

A separator plate construction for flake-like members including a plate body having a longitudinal axis, a plurality of elongated slot openings in the plate body extending longitudinally of the longitudinal axis, and orienters on the plate body for orienting elongated flake-like members which are thinner but wider than the openings into a direction extending longitudinally of the openings and rotating them so that they can pass through the openings.

31 Claims, 3 Drawing Sheets

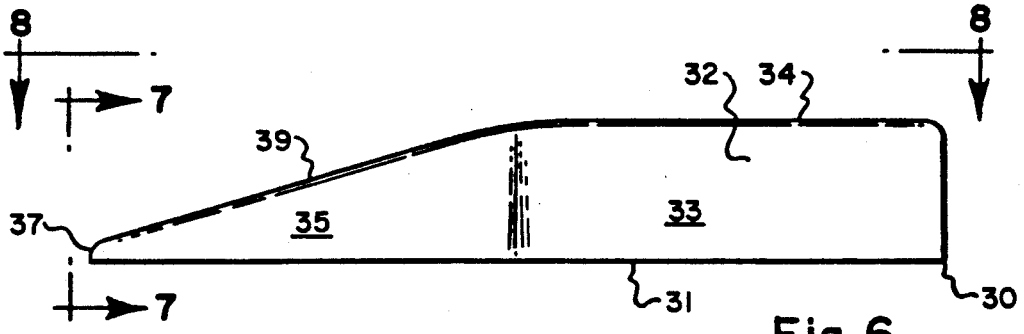
Fig. 6.
Fig. 7.
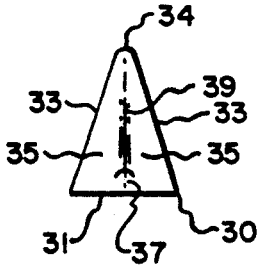
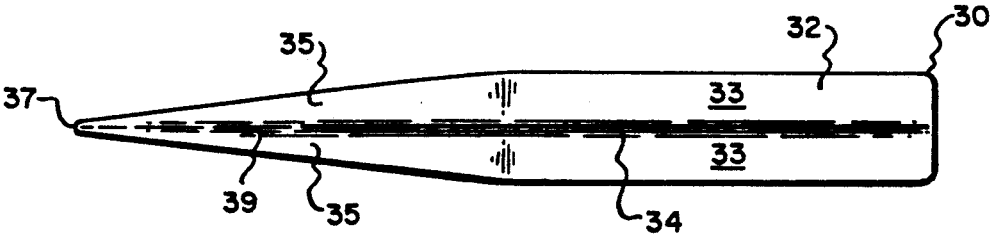
Fig. 8.
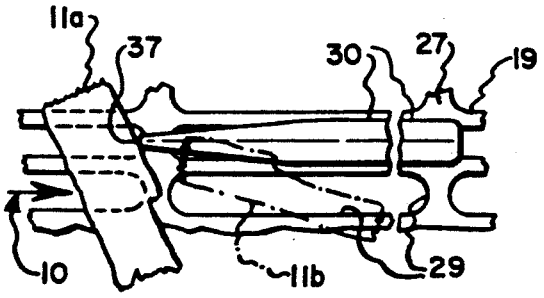
Fig. 9.
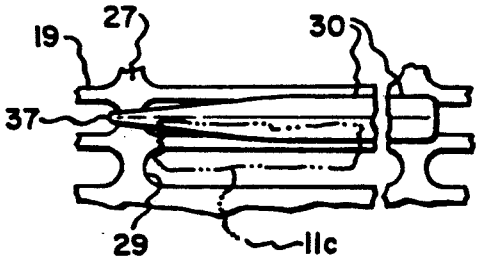
Fig. 10.

Fig. 11b.
Fig. 11.
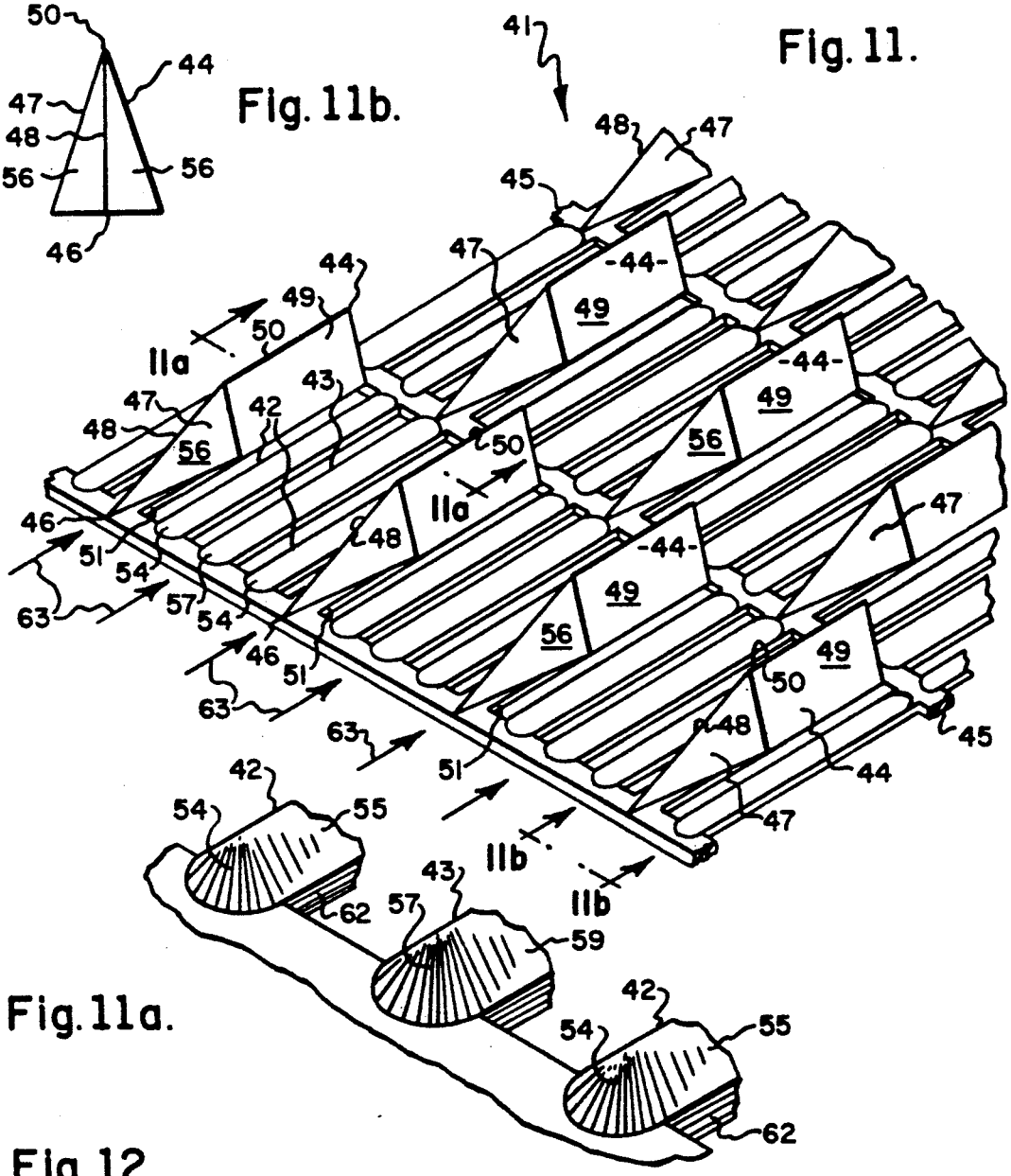
Fig. 11a.
Fig. 12.
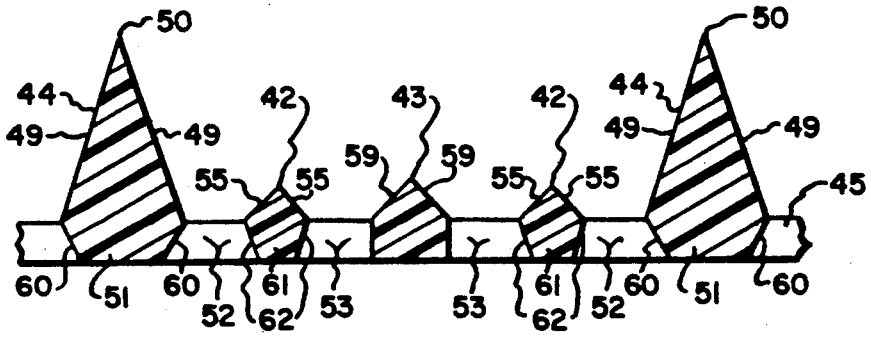

VIBRATORY SEPARATOR PLATE FOR FLAKE-LIKE MEMBERS

BACKGROUND OF THE INVENTION

The present invention relates to a separator plate construction for a vibratory separator machine.

By way of background, in the building materials industry, pressed boards are fabricated by pressing chips, flakes and slivers of wood with a suitable binder. These chips, flakes and slivers are made by shaving rotating logs with a blade, much in the manner in which a lathe shaves metal. However, during the process of shaving the log, rolls or curls of sheet material are also formed. These rolls, which are called "cigars" in the industry, are formed by the wood curling during the shaving process.

In the past, the rolls or "cigars", when not separated from the other particles, and pressed into boards with a binder, created voids therein or weak spots in the surface which formed depressions when they broke. Obviously this resulted in pressed boards which were not commercially desirable.

SUMMARY OF THE INVENTION

It is one object of the present invention to provide a separator plate for a vibratory separator machine which will pass flakes, slivers and chips of wood but will not pass rolls thereof, to thereby produce a desired separation of the foregoing materials.

It is a broader object of the present invention to provide a separator plate construction for a vibratory separator machine which will not only pass particles which are thinner, narrower and shorter than openings therein and but which will also orient particles which are thinner but wider than the openings so that they may pass therethrough. Other objects and attendant advantages of the present invention will readily be perceived hereafter.

The present invention relates to a separator plate construction for flake-like members comprising a plate body having a plurality of elongated slot openings in said plate body, and orienter means on said plate body for orienting elongated flake-like members which are thinner but wider than said openings into a direction extending longitudinally of said openings with the portions thereof having said thinness dimension aligned with said openings so that they can pass through the openings.

The various aspects of the present invention will be more fully understood when the following portions of the specification are read in conjunction with the accompanying drawings wherein:

BRIEF DESCRIPTION OF THE DRAWINGS

FIG. 6 is an enlarged view taken substantially in the direction of arrows 6—6 of FIG. 5 and showing a orienter member in side elevation;

FIG. 7 is an end elevational view taken substantially in the direction of arrows 7—7 of FIG. 6;

FIG. 8 is a plan view of the orienter member taken substantially in the direction of arrows 8—8 of FIG. 6;

FIG. 9 is a schematic view showing how a orienter member aligns an elongated flake which passes along the separator plate;

FIG. 10 is a schematic view showing how the orienter member rotates the elongated flake so that it can drop through the elongated slot opening in the plate;

FIG. 11 is a fragmentary perspective view of a modified form of separator plate which is fabricated of molded polyurethane;

FIG. **11*a* is an enlarged fragmentary perspective view of the nose portions of the dividers of the plate of FIG. 11**;

FIG. **11*b* is a front view of an orienter taken in the direction of arrows 11*b*–11*b* of FIG. 11; and FIG. 12 is a cross sectional view taken substantially along line 12—12 of FIG. 11** and showing the cross sectional configuration of the various members of the modified plate.

DESCRIPTION OF THE PREFERRED EMBODIMENTS

Figure 1:
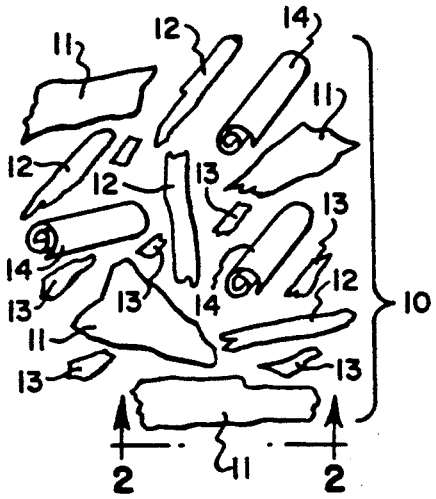
FIG. 1 is a plan view of a mass of randomly oriented wooden members consisting of flakes, slivers, chips and rolls which have been shaved from logs.
Figure 2:
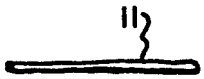
FIG. 2 is a view taken substantially in the direction of arrows 2—2 of FIG. 1 and showing the thickness of an elongated flake member.
Figure 3:
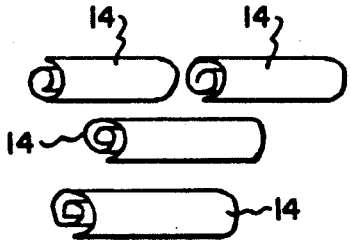
FIG. 3 is a perspective view of a plurality of wood rolls.

In FIG. 1 there is shown a mass of randomly oriented wood particles including flakes of various widths, slivers of various lengths, chips of various sizes and rolls, all of which are obtained by shaving of rotating logs with a blade about 3" wide, and thus the flakes and slivers are generally not more than about 3" long, and the chips are shorter. All of the foregoing particles, except for the rolls 14 are of approximately the same thickness, namely about 1 to 3 millimeters thick. The rolls 14 are essentially cylindrical shavings generally about 3" long and from about ½" to 1" in diameter. Rolls 14, which are termed "cigars" because of their resemblance thereto, are formed during the shaving process as the shaving curls but does not break up into flakes, slivers or chips. The wood particles of FIG. 1 are shown separated from each other for the sake of illustration.

In the building materials industry, random masses of materials depicted in FIG. 1 have been mixed with a suitable binder and pressed into boards used for building. However, whenever the rolls 14 were mixed with the remainder of the components of FIG. 1, they produced hollow spots in the board which created inferior boards. In this respect, the hollow portions were weak spots, and further, if the rolls were near the surface, they sometimes broke and created depressions or the edges of the rolls would break loose and pop up to create an uneven surface.

In the past, insofar as known, there was no commercial way of separating the rolls 14 from the remainder of mass 10 so that the particles 11, 12 and 13 could be the only ones which were incorporated into a composition board.

Figure 4:
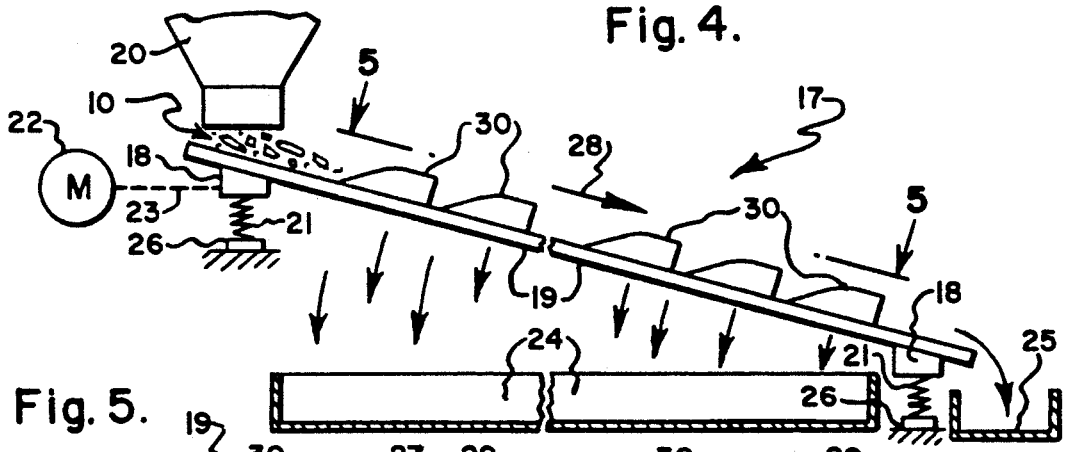
FIG. 4 is a schematic view of the separator plate of the present invention mounted on a vibratory separator machine and also showing the feed hopper for the mass of randomly oriented material of FIGS. 1, 2 and 3 and the receptacles for receiving the separated materials.

The present vibratory separator machine 17 utilizes a separator plate 19 for separating the rolls 14 from the flakes 11, slivers 12 and chips 13. Broadly, the vibratory separator 17 includes a hopper 20 from which the mass 10 of randomly oriented materials 11, 12, 13 and 14 is discharged. Basically, vibratory separator machine 17 includes a separator plate 19 which is suitably mounted on a machine frame portion 18 which in turn is mounted on the stationary machine frame portion 26 by resilient mounts 21 and vibrated by motor 22 connected to frame portion 18 by suitable linkage 23. The machine 17, except for plate 19, can be any conventional vibratory screening machine which is well known in the art and includes the frame 18 which mounts plate 19 in an inclined attitude as shown in FIG. 4. As plate 19 is vibrated, the mass 10 will travel downwardly and the flakes 11, slivers 12 and chips 13 will pass through plate 19 into a receptacle 24 while the rolls 14 will ride along the surface of plate 19 to its very end and drop into receptacle 25. Conveyors may be utilized instead of receptacles 24 and 25 to move the separated particles away from machine 17.

Separator plate 19 includes a metal plate body 27 having a plurality of elongated slot openings 29 therein. Openings 29 are longer than the longest flakes 11 and slivers 12, and they are obviously longer than the chips 13. In a model which was made the openings 29 were about 6" long and about ½" wide. However, the slots may be dimensioned as required for any specific type of application. As the mass 10 rides downwardly along plate 19 in the direction of arrow 28, the slivers 12 and chips 13 will fall through elongated slots 29 when they are aligned therewith because their width and thickness is less than the width of slots 29. However, the rolls 14 which are wider than the width of elongated slot openings 29 can never pass therethrough and will drop into receptacle 25.

Separator plate 19 possesses structure for causing flakes 11, which are wider but thinner than openings 29, to be oriented so that they will fall through openings 29 into receptacle 24. More specifically, a plurality of fin-like orienters 30 are mounted on plate body 27. Each orienter 30 includes a lowermost or base portion 31 which is suitably mounted on plate body 27. In this respect, it can be clamped thereto in any suitable manner or it can be permanently affixed thereto by welding or gluing or it can be of a configuration wherein it is snapped into an appropriate elongated slot opening 29. Each orienter 30 also includes a main body portion 32 with sides 33 which slope upwardly from base 31 and terminate at an apex 34 which is preferably slightly rounded. The fore portion or nose 37 of orienter 30 is of solid triangular configuration which tapers to a tip. Nose 37 has sides 35 which diverge from its tip and it has an apex 39 which merges into apex 34. While the orienters have been shown with downwardly sloping sides 33, they can also function if the sides do not slope downwardly, but are substantially parallel.

In operation, as separator plate 19 is vibrated, the mass 10 will travel downwardly in the direction of arrow 28. As noted above, the slivers 12 and chips 13 will be aligned with openings 29 because of the manner in which plate 27 is vibrated, and they will pass therethrough. In this respect, any slivers which are moving downwardly with their longitudinal axes transverse to the longitudinal axes of the orienters 30 will be turned by the orienters into a longitudinal attitude and thus will then drop through the openings 29. The orienters 30 will also reorient the flakes 11 as shown in FIGS. 9 and 10 so that they will drop through openings 29. In this respect, a flake is shown at 11*a* when it first hits the nose portion 37 of orienter 30. It will then be oriented into the position 11*b*. Thereafter, it will be rotated about its longitudinal axis to a position 11*c* so that its thickness dimension is aligned with an opening 29 whereupon it will drop therethrough. Thus, flakes 11, which are wider but thinner than openings 29, can drop therethrough, whereas if they remained flat on plate 19, they would be too wide to drop therethrough.

Figure 5:
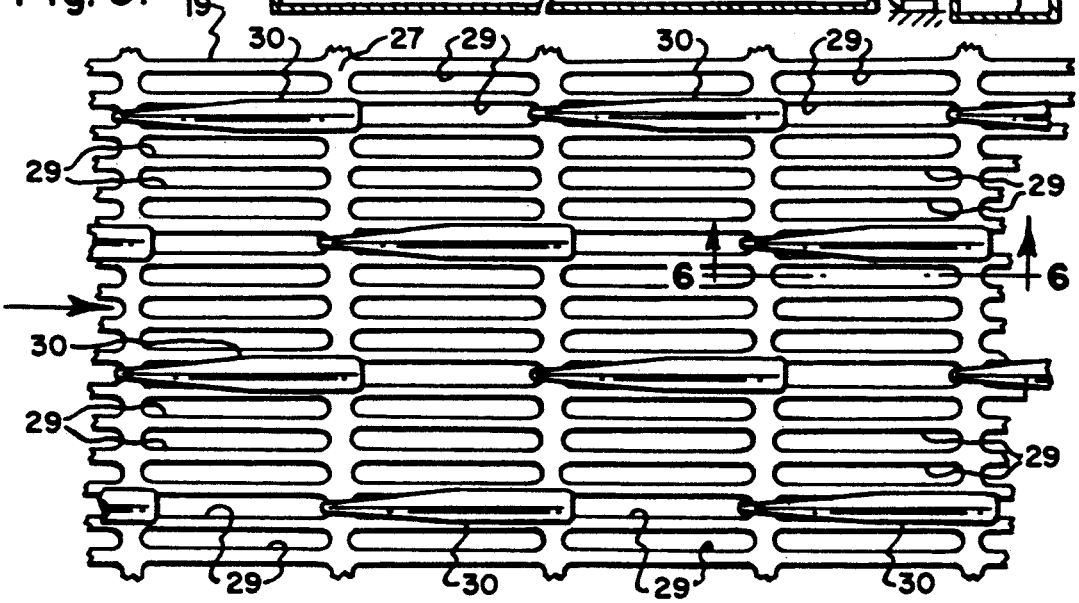
FIG. 5 is a fragmentary plan view taken substantially in the direction of arrows 5—5 of FIG. 4 and showing a separator plate construction.

In FIG. 5 the orienters 30 are shown in an orientation wherein they are in aligned rows. However, they can be installed in any desired orientation so that there will be no rows extending longitudinally between them which are wider than the length of the longest flakes 11. Thus, all the flakes will have to encounter orienters 30 during their travel along separator plate 19 and thus be oriented to drop through openings 29 in the manner discussed above relative to FIGS. 9 and 10.

In FIG. 11 a molded polyurethane separator plate 41 is shown wherein longitudinally extending dividers 42 and 43 are located between orienters 44, all of which can be considered fin-like and, as can be seen from FIG. 11, the fin-like members 42 and 43, on one hand and the fin-like members 44, on the other hand, have different heights. The opposite ends of members 42, 43 and 44 are molded integrally with cross members 45. All of the foregoing members are bounded by an integrally molded polyurethane frame, not shown.

Each orienter 44 includes a rearwardly sloping nose portion 47 of solid triangular configuration having a tip 46 and a rearwardly sloping apex 48 and sides 56. Each nose portion 47 functions generally in the same manner as the nose portion 37 of each orienter 30. Each orienter 49 beyond nose portion 47 is symmetrical about its vertical centerline and includes downwardly sloping sides 49 which diverge downwardly from an apex 50. These sides 49 function in the same manner as sides 33 of orienters 30. Each orienter 44 also is mounted on an integral base 51, the opposite ends of which are molded integrally with cross members 45. The slots 52 are the spaces between dividers 42 and orienters 44. The slots 53 are the spaces between dividers 42 and 43. All of these slots are of the same size. The dividers 42 have curved nose portions 54 and downwardly sloping sides 55 beyond nose portions 54. Thus, each divider 42 functions in the manner described above relative to orienters 30 in that any flakes which hit them crosswise will tend to be turned into alignment with openings 52 and 53 and pass therethrough. Also, elongated dividers 43 have curved nose portions 57 and downwardly sloping sides 59 beyond nose portions 57, and they also orient the flakes to fall through the elongated openings 53 on opposite sides thereof. Furthermore, as can be seen, the orienters 44 are staggered relative to each other in cross rows as are the dividers 42 and 43. The bases 51 of orienters 44 have downwardly converging sides 60. Also, dividers 42 have bases 61 with downwardly converging sides 62. The downwardly converging sides 60 and 62 prevent jamming of the flakes as they pass therethrough because they cause the openings 52 and 53 to diverge downwardly. The flow of material on plate 41 is in the direction of arrows 63.

It can thus be seen that the separator plates of the present invention are manifestly capable of permitting flakes, slivers and chips which pass through the slots, but which will not pass undesirable rolls.

While the foregoing description has been directed to the separating of flakes, slivers and chips from rolls of wood, it will be appreciated that the separator plate constructions of the present invention are also capable of performing the same function with materials other than wood which have analogous dimensional characteristics.

Thus, the separator plates of the present invention are manifestly capable of achieving the above-enumerated objects, and while preferred embodiments of the present invention have been disclosed, it will be appreciated that it is not limited thereto but may be otherwise embodied within the scope of the following claims.

What is claimed is:

1. A separator plate construction for elongated flake-like members having thickness and width dimensions comprising a plate body, a plurality of elongated slot openings in said plate body which are wider than said thickness dimensions but less wide than said width dimensions of said flake-like members, and orienter means on said plate body having side means which extend upwardly from said plate body immediately adjacent to said elongated slot openings for engaging and lifting portions of said elongated flake-like members which contact said side means so that said elongated flake-like members are lifted into an orientation with their thickness dimensions and their width dimensions extending longitudinally of and aligned with elongated slot openings which are immediately adjacent to said orienter means which engaged and lifted said flake-like members so that they pass through said openings.

2. A plate construction for a vibratory separator machine for separating elongated flake-like members having a thickness dimension and a width dimension which is larger than said thickness dimension from other members which have a smallest dimension which is larger than the thickness dimension of said flake-like members comprising a plate body having a plate axis, a plurality of elongated slot openings in said plate body extending longitudinally of said plate axis, said elongated slot openings being wider than said thickness dimension of said elongated flake-like members but less wide than said smallest dimension of said other members, and orienter means on said plate body having side means which extend upwardly from said plate body immediately adjacent to said elongated slot openings for engaging and lifting portions of said elongated flake-like members which contact said side means so that said elongated flake-like members are lifted into an orientation with their thickness dimensions and their width dimensions extending longitudinally of and aligned with elongated slot openings which are immediately adjacent to said orienter means which engaged and lifted said flake-like members as said elongated flake-like members pass in a random orientation in a direction longitudinally of said plate axis as said plate body is vibrated in an inclined attitude for causing said elongated flake-like members to fall through said elongated slot openings notwithstanding that said width dimension thereof is wider than said width of said elongated slot openings while said other members are prevented from passing through said slot openings because their smallest dimension is greater than the width of said slot openings.

3. A plate construction as set forth in claim 2 wherein said orienter means include means for orienting said flake-like members into an orientation lengthwise of said elongated slot openings, and means for rotating said elongated flake-like members so that the portions thereof with said thickness dimensions enter said elongated slot openings.

4. A plate construction as set forth in claim 2 wherein said plate body includes upper and lower surfaces between which said elongated slot openings extend, and wherein said orienter means comprise upstanding fin-like members above said upper surface which extend in the direction of said plate axis.

5. A plate construction as set forth in claim 4 wherein said fin-like members include tapered fore portions and wherein said side means are located on said fin-like members and slope toward said elongated slot openings.

6. A plate construction as set forth in claim 4 wherein said side means are located on said fin-like members and slope toward said elongated slot openings.

7. A plate construction as set forth in claim 6 wherein said elongated slot openings have sides which diverge downwardly between said upper and lower surfaces.

8. A plate construction as set forth in claim 4 wherein said elongated slot openings have sides which diverge downwardly between said upper and lower surfaces.

9. A plate construction as set forth in claim 8 wherein certain of said fin-like members have different heights.

10. A plate construction as set forth in claim 9 wherein said side means are located on said fin-like members and slope toward said elongated slot openings.

11. A plate construction as set forth in claim 4 wherein certain of said fin-like members have different heights.

12. A plate construction as set forth in claim 4 wherein said fin-like members have main body portions which are located between and immediately adjacent to elongated slot openings on opposite sides thereof, and wherein said side means which extend upwardly from said plate body are located on opposite sides of each of said main body portions and lead toward said elongated slot openings which are immediately adjacent to and are located on opposite sides of said main body portion.

13. A plate construction as set forth in claim 12 wherein said side means on opposite sides of said main body portions slope upwardly at an angle from said slot openings.

14. A plate construction as set forth in claim 12 wherein said slot body includes upper and lower surfaces between which said elongated slot openings extend, and wherein said elongated slot openings have sides which diverge downwardly between said upper and lower surfaces.

15. A plate construction as set forth in claim 12 wherein said main body portions include tapered fore portions.

16. A plate construction as set forth in claim 15 wherein said side means on opposite sides of said main body portions slope upwardly at an angle from said slot openings.

17. A plate construction as set forth in claim 12 wherein certain of said main body portions have different heights.

18. A plate construction as set forth in claim 17 wherein said main body portions include tapered fore portions.

19. A plate construction as set forth in claim 18 wherein said side means on opposite sides of said main body portions slope upwardly at an angle from said slot openings.

20. A plate construction as set forth in claim 19 wherein said plate body includes upper and lower surfaces between which said elongated slot openings extend, and wherein said elongated slot openings have sides which diverge downwardly between said upper and lower surfaces.

21. A plate construction as set forth in claim 12 wherein said plate body and said orienter means are fabricated of molded polyurethane.

22. A plate construction as set forth in claim 21 wherein certain of said main body portions have different heights.

23. A plate construction as set forth in claim 2 wherein said plate body and said orienter means are fabricated of molded polyurethane.

24. A plate construction as set forth in claim 23 wherein said plate body includes upper and lower surfaces between which said elongated slot openings extend, and wherein said orienter means comprise upstanding fin-like members above said upper surface which extend in the direction of said plate axis.

25. A plate construction as set forth in claim 24 wherein said side means are located on said fin-like members and slope toward said elongated slot openings.

26. A plate construction as set forth in claim 25 wherein certain of said fin-like members have various heights.

27. A plate construction as set forth in claim 26 and wherein said elongated slot openings have sides which diverge downwardly between said upper and lower surfaces.

28. A plate construction as set forth in claim 24 wherein certain of said fin-like members have different heights.

29. A plate construction as set forth in claim 28 and wherein said elongated slot openings have sides which diverge downwardly between said upper and lower surfaces.

30. A plate construction as set forth in claim 24 and wherein said elongated slot openings have sides which diverge downwardly between said upper and lower surfaces.

31. A plate construction as set forth in claim 30 wherein said side means are located on said fin-like members and slope toward said elongated slot openings.

* * * * *

UNITED STATES PATENT AND TRADEMARK OFFICE

CERTIFICATE OF CORRECTION

PATENT NO. : 5,211,291

DATED : May 18, 1993

INVENTOR(S) : Christopher P. Kelley and John A. Tanner

It is certified that error appears in the above-identified patent and that said Letters Patent is hereby corrected as shown below:

Column 6, line 36 (claim 12), change "portion" to --portions--.

Column 6, line 42 (claim 14), change "slot" to --plate--.

Signed and Sealed this

First Day of February, 1994

Bruce Lehman

*Attest:*

BRUCE LEHMAN

*Attesting Officer*

*Commissioner of Patents and Trademarks*